US005611718A

United States Patent [19]

Nishiyama

[11] Patent Number: 5,611,718

[45] Date of Patent: Mar. 18, 1997

[54] AUXILIARY PROPELLING DEVICE

[75] Inventor: Shigeki Nishiyama, Mie, Japan

[73] Assignee: Mikado Propeller Co., Ltd., Nabari, Japan

[21] Appl. No.: 518,302

[22] Filed: Aug. 23, 1995

[30] Foreign Application Priority Data

Aug. 23, 1994 [JP] Japan ..... 6-198641

[51] Int. Cl.[6] ..... B63H 5/07

[52] U.S. Cl. ..... 440/49; 416/244 B; 416/245 A; 440/81

[58] Field of Search ..... 440/49, 81, 83; 416/244 B, 245 A

[56] References Cited

U.S. PATENT DOCUMENTS 2,351,356 6/1944 Meyer ..... 416/244 B 3,422,905 1/1969 Muller ..... 416/244 B 4,391,567 7/1983 Ciampolillo ..... 416/245 A 4,538,962 9/1985 McCain ..... 416/244 B

*Primary Examiner*—Sherman Basinger

*Attorney, Agent, or Firm*—Wenderoth, Lind & Ponack

[57] ABSTRACT

An auxiliary propelling structure can be attached to an existing propeller system including a propeller having a boss, a propeller shaft and a tightening nut screwed onto the end of the shaft. The auxiliary propelling structure includes an auxiliary boss that is approximately cylindrical to enclose closely the tightening nut of the existing propeller system and having an internal partition with a central through-hole. The partition is pressed against the tightening nut.

12 Claims, 2 Drawing Sheets

AUXILIARY PROPELLING DEVICE

FIELD OF INVENTION

The invention relates to an auxiliary propeller or propelling device to improve the propelling performance in high speed boats or fishing boats, and which requires little or no modification of an existing propeller shaft system.

BACKGROUND OF INVENTION

To improve propelling efficiency in existing boats, there have been proposed a technique of providing an auxiliary propeller or propelling device such as an AT fin (Addition Thruster Fin) at the rudder behind an ordinary propeller, or the technique of providing an auxiliary propeller or propelling device such as a PBCF (Propeller Boss Cup Fin) immediately behind the propeller to improve the efficiency of the propeller itself. In the latter technique, the axial space associated with the ordinary propeller shaft is very limited, and therefore it is necessary to enlarge the propeller shaft or to provide a new propeller shaft.

SUMMARY OF THE INVENTION

An object of the invention is to provide an assembly structure of an auxiliary propelling device that can easily improve propelling performance without modification, or with minor modification, of an existing propeller shaft.

In one embodiment of the invention, an auxiliary propeller or propelling device is provided at an end portion of a propeller shaft, immediately behind a propeller boss mounted on the propeller shaft and a tightening nut threaded onto a screw portion of an end of the propeller shaft to fix the propeller boss thereto. A screw hole is provided in the propeller shaft along the central axis thereof. An auxiliary boss member has an internal partition with a central through-hole. A front end of the boss member is engaged with a rear end of propeller boss. An assembly bolt extends through the through-hole in the partition and is threaded into the screw hole in the propeller shaft. It is a characteristic of this embodiment that a head of the assembly bolt will clamp the internal partition of the auxiliary propelling device.

In a second embodiment, an assembly nut is threaded over an end portion of the propeller shaft that extends through the internal partition of the auxiliary propelling device. It is a characteristic of this embodiment that the assembly nut will clamp the internal partition of the auxiliary propelling device.

According to the invention, the end of an existing propeller shaft can be used to assemble and to clamp boss member portion of the auxiliary propelling device to an existing propeller system. According to the first embodiment, the auxiliary propelling device can be assembled with only a slight modification of the end of the existing propeller shaft system, i.e. by forming a screw hole therein. According to the second embodiment, no modification of the end of the existing propeller shaft is necessary. Further according to the second embodiment, if the end of the propeller shaft has sufficient length of a pair double nuts, then even if conditions do not allow tapping in the shaft end, the auxiliary propelling device nevertheless can be assembled on and existing propeller shaft system without restructuring thereof.

BRIEF DESCRIPTION OF THE DRAWINGS

Preferred embodiments of the invention will be described in conjunction with the following drawings.

DETAILED DESCRIPTION OF PREFERRED EMBODIMENTS

First embodiment

Figure 1:
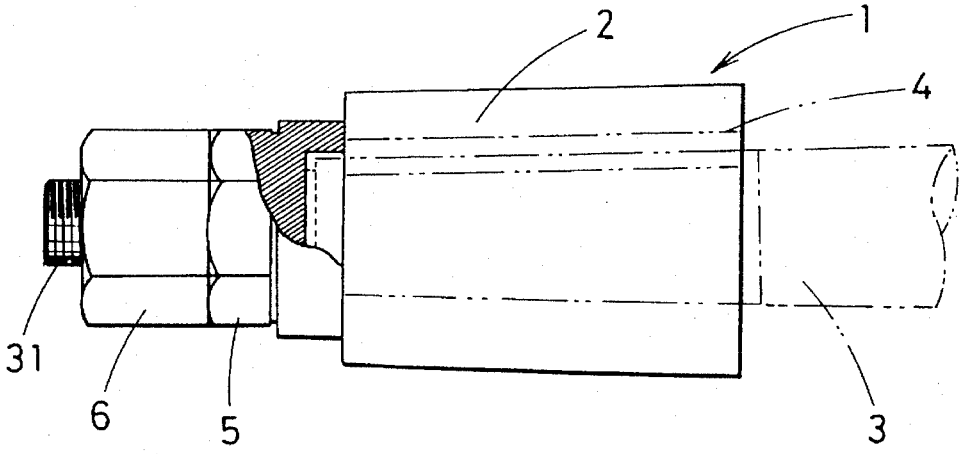
FIG. 1 is a partial sectional view of a boat propelling system before assembly with an auxiliary propelling device.

FIG. 1 shows a double-nut type structure for mounting of an ordinary propeller 1. A propeller boss 2 (propeller blades not shown) is fixed to propeller shaft 3 by such ordinary double-nut structure. In other words, key 4 locks propeller boss 2 to propeller shaft 3 to prevent relative rotational movement therebetween. Tightening nut 5 is screwed onto screw portion 31 at the end of propeller shaft 3 against propeller boss 2. Tightening nut 6 is screwed onto screw portion 31 of propeller shaft 3 against tightening nut 5 in a reinforcing manner. Herein, the term "screw portion" will be understood to mean a threaded portion which is profiled to accept a nut or similarly threaded component in a complementary and tight relationship.

Figure 2:
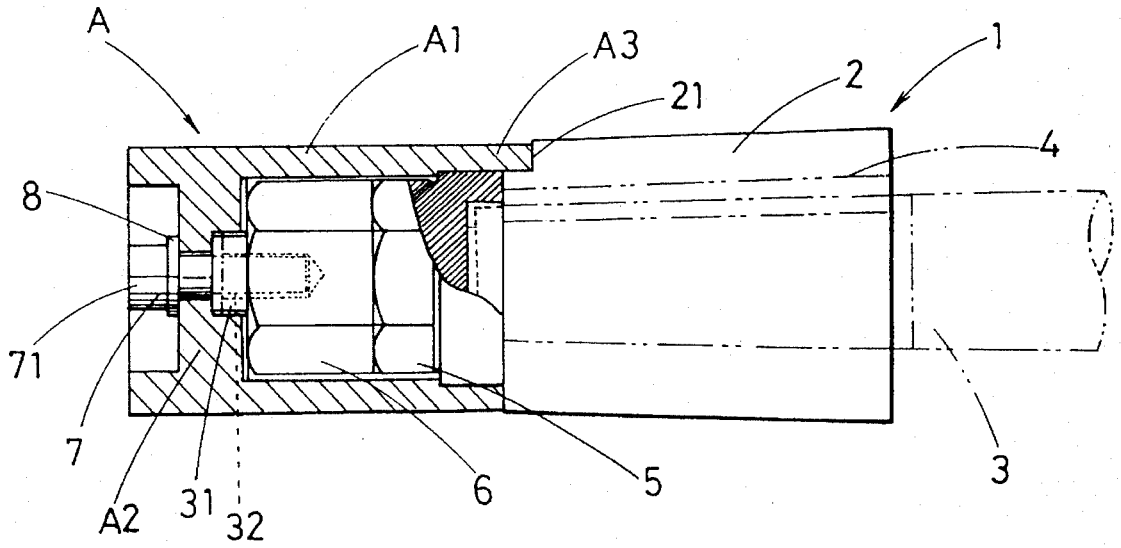
FIG. 2 is a partial sectional view of a first embodiment of an auxiliary propelling device of the invention, shown mounted on the propelling system of FIG. 1.

FIG. 2 shows an assembly of the propeller plus the ordinary double-nut type structure of FIG. 1, but having mounted thereon an auxiliary propelling device A according to a first embodiment of the invention. Device A includes a boss member A1 having adjacent a rear end thereof an internal partition A2 having therethrough a central through-hole. Partition A2 defines two axially spaced interior portions. One or more convex portions A3 are formed at a front end of boss member A1. A screw hole 32, having the same axis as the propeller shaft 3, is formed in the end of propeller shaft 3. Corresponding to the one or more convex portions A3 are one or more complementary concave parts 21 formed at the rear end of propeller boss 2.

To install auxiliary propeller or propelling device A on the structure shown in FIG. 1, propeller boss member A1 of auxiliary propelling device A is fitted over nut 5 and nut 6 at the end of propeller shaft 3 with nuts 5, 6 within one interior portion of member A1. Convex portion A3 of boss member A1 of auxiliary propelling device A is engaged in a tightly complementary manner with complementary concave portion 21 of propeller boss 2. An assembly bolt 7 is extended through a spring washer 8 and the through-hole in partition A2 and is screwed into screw hole 32 in the end of propeller shaft 3. Head 71 of bolt 7 presses washer 8 to abut the rear end of internal partition A2. Head 71 fits in the other interior portion of member A1. Thereby, internal partition A2 of auxiliary propelling device A is clamped and pressed against nut 6 by head 71 of assembly bolt 7. Thus, boss member A1 of auxiliary propelling device A is fixed rigidly to propeller shaft 3. Furthermore, boss member A1 is fixed very firmly in the radial direction because the gap formed between the external peripheral surface of nut 5 and the inner peripheral surface of boss member A1 of auxiliary propelling device A is very small.

The assembled structure of the auxiliary propelling device and propeller boss 2 rotate in the same direction at the same rotating speed. The result is that the plurality of blades extending in almost the same radial direction (not shown) from each of boss member A1 and boss 2 generate thrust efficiently.

Second Embodiment

Figure 3:
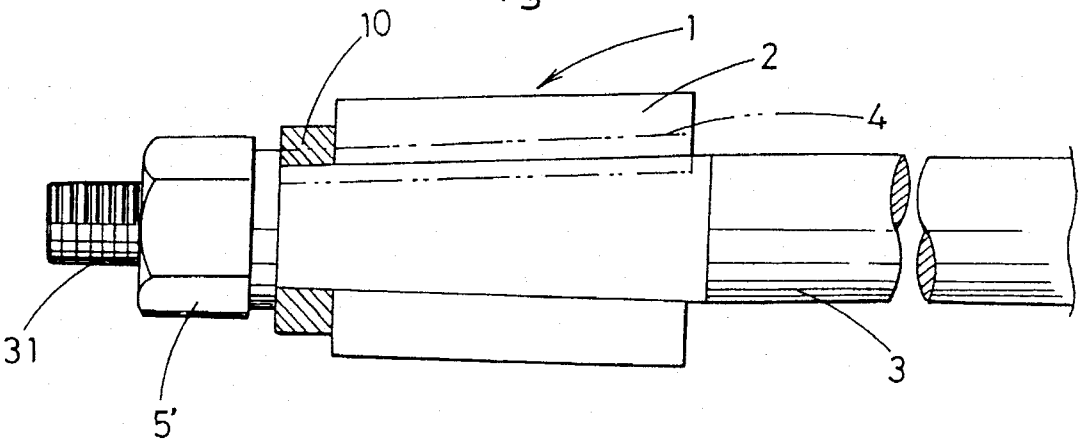
FIG. 3 is a partial sectional view of another boat propelling system before assembly with an auxiliary propelling device.

FIG. 3 shows propeller 1 fixed to end portion of shaft 3 by a tightening nut 5' to prevent loosening from the end portion. Propeller boss 2 (propeller blades not shown) is fixed to propeller shaft 3 as follows. Propeller boss 2 is mounted onto propeller shaft 3 by means of key 4, tightening nut 5' and ring 10 between boss 2 and nut 5'. Tightening nut 5' is screwed onto screw portion 31 formed at the end of propeller shaft 3 in a manner similar to that described above regarding the first embodiment.

Figure 4:
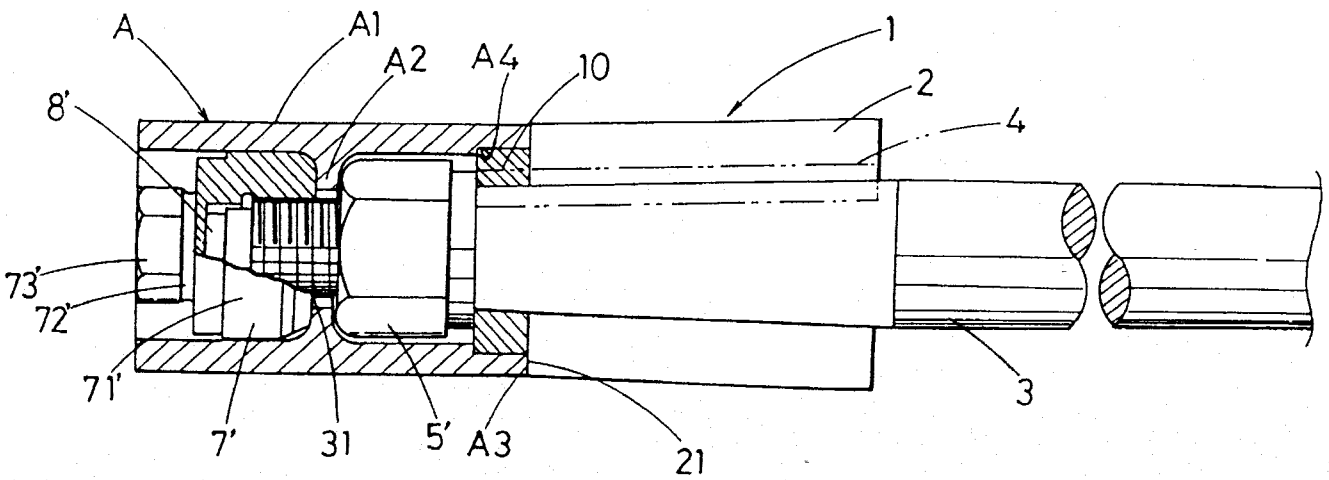
FIG. 4 is a partial sectional view of a second embodiment of an auxiliary propelling device of the invention, shown mounted on the propelling system of FIG. 3.

FIG. 4 shows an assembly of another embodiment of auxiliary propeller or propelling device A mounted immediately behind propeller 1. Device A includes a boss member A1 having adjacent a rear end thereof an internal partition A2 having therethrough a central through-hole. Partition A2 divides the interior of member A1 into two axially spaced interior portions. One or more convex portions A3 are formed at a front end of propeller boss member A1 and engage in a tightly complementary concave portion 21 formed in the rear end of propeller boss 2. A step portion A4 is formed in the inner surface of a front end portion of boss member A1 to engage ring 10. Tightening nut 7' fixes auxiliary propelling device A to propeller shaft 3. Tightening nut 7' is a pocket nut with the same size screw thread as tightening nut 5'. Nut 7' has a polygonal head 73' formed on a cap portion 72'. Main part or body 71' of nut 7' has a cylindrical exterior periphery shaped with an outer dimension about the same as the inner dimension of boss member A1 of auxiliary propelling device A.

To install the auxiliary propelling device A on the structure shown in FIG. 3, boss member A1 is fitted over tightening nut 5' fixed to shaft 3 with nut 5' within one interior portion of member A1. Convex portion A3 of boss A1 is engaged in a tightly complementary manner with concave portion 21 of propeller boss 2. Step portion A4 of boss portion A2 engages a rear edge of ring 10. An end part of screw portion 31 at the end of propeller shaft 3 which extends beyond tightening nut 5' extends through the through hole in portion A2. Tightening nut 7' is extended through a spring washer 8' from the rear end of boss member and threaded onto the end part of screw portion 31. A wrench engaging head 73' of tightening nut 7' tightens tightening nut 7' onto screw portion 31 of propeller shaft 3. Nut 7' fits within the other interior portion of member A1. An end surface of tightening nut 7' thereby is urged strongly against internal partition A2 of boss member, and boss member A1 thereby is fixed completely in the axial direction of propeller shaft 3. Convex portion A3 of boss member A1 is engaged in a tightly complementary manner with concave portion 21 of propeller boss 2. With the additional locking provided by key 4, propeller 1 and auxiliary propelling device A will be fixed in the rotating direction of propeller shaft 3. Furthermore, tight radial fixing of device A is achieved at two positions, i.e. at ring 10 and main body 71'. Thus, device A is constructed to be effectively integral with propeller shaft 3 and also fixed with propeller shaft 3 in the radial direction due to centrifugal force.

Therefore, in the second embodiment auxiliary propelling device A can be fixed immediately behind propeller boss 2 without restructuring the existing propeller shaft system. Thrust can be generated efficiently by a plurality of blades (not shown) of almost radial configuration extending from each of boss member A1 and boss 2 that rotate the same number of rotations in almost the same direction.

While particular embodiments of the invention have been disclosed, it is to be understood that various different modifications are possible and are contemplated as being within the true spirit and scope of the invention.

I claim:

1. An auxiliary propeller device to be attached to an existing propeller system including a propeller shaft, a propeller including a propeller boss mounted on the shaft and a tightening nut threaded on the shaft and maintaining the propeller boss thereon, said auxiliary propeller device comprising:

a cylindrical auxiliary propeller boss member having an interior divided into axially spaced first and second interior portions by an integral internal partition of said boss member, said boss member being fittable over the tightening nut and an end of the propeller shaft with said first interior portion forming means for accommodating therein the tightening nut;

an auxiliary tightening member at least partially accommodated in said second interior portion, said auxiliary tightening member defining means cooperable with the end of the shaft for forcing said internal partition in a direction to press against the tightening nut; and said boss member having at a front end thereof at least one convex portion forming means for, when said auxiliary tightening member forces said internal partition in said direction, cooperating with a complementary concave portion of the propeller boss to fix said boss member to the propeller boss rotationally relative thereto and to prevent relative rotational displacement therebetween upon rotation of the propeller shaft.

2. An auxiliary propeller device as claimed in claim 1, wherein said boss member and said internal partition comprise a unitary one-piece structure of the same material.

3. An auxiliary propeller device as claimed in claim 1, wherein said internal partition has therethrough a central through-hole.

4. An auxiliary propeller device as claimed in claim 3, wherein said auxiliary tightening member comprises a bolt extending through said through-hole to be threaded into a screw hole in the end of the shaft, said bolt having a head positioned in said second interior portion and operable upon threaded tightening of said bolt to force said internal partition in said direction.

5. An auxiliary propeller device as claimed in claim 3, wherein said auxiliary tightening means comprises a nut positioned in said second interior portion and operable to be threadably tightened over an end portion of the shaft extending through said through-hole to thereby force said internal partition in said direction.

6. An auxiliary propeller device as claimed in claim 5, wherein said boss member has an interior step portion to engage an edge of a ring to be positioned on the shaft between the propeller boss and the tightening nut.

7. A propeller system comprising a propeller shaft having a threaded end, a propeller including a propeller boss mounted on said shaft, a tightening nut threaded onto said threaded end of said shaft and fixing said propeller boss thereon, and an auxiliary propeller device comprising:

a cylindrical auxiliary propeller boss member having an interior divided into axially spaced first and second interior portions by an integral internal partition of said auxiliary boss member, said boss member being fit over said tightening nut and an end portion of said threaded end of said propeller shaft with said tightening nut being accommodated in said first interior portion;

an auxiliary tightening member at least partially accommodated in said second interior portion, said auxiliary tightening member defining means cooperating with said end portion of said shaft for forcing said internal partition in a direction pressing against said tightening nut; and said boss member having at a front end thereof at least one convex portion forming means for, when said auxiliary tightening member forces said internal partition in said direction, cooperating with a complementary concave portion of said propeller boss to fix said boss member to said propeller boss rotationally relative thereto and to prevent relative rotational displacement therebetween upon rotation of said propeller shaft.

8. A propeller system as claimed in claim 7, wherein said boss member and said internal partition comprise a unitary one-piece structure of the same material.

9. A propeller system as claimed in claim 7, wherein said internal partition has therethrough a central through-hole.

10. A propeller system as claimed in claim 9, wherein said auxiliary tightening member comprises a bolt extending through said through-hole and threaded into a screw hole in said end portion of said shaft, said bolt having a head positioned in said second interior portion and operable upon threaded tightening of said bolt to force said internal partition in said direction.

11. A propeller system as claimed in claim 9, wherein said auxiliary tightening means comprises a nut positioned in said second interior portion and threadably engaging said end portion of said shaft extending through said through-hole to thereby force said internal partition in said direction.

12. A propeller system as claimed in claim 11, wherein said boss member has an interior step portion engaging an edge of a ring positioned on said shaft between the propeller boss and said tightening nut.

* * * * *